US009091500B1

(12) United States Patent
Kim

(10) Patent No.: US 9,091,500 B1
(45) Date of Patent: Jul. 28, 2015

(54) APPARATUS FOR STORING AND LOADING AMMUNITION

(71) Applicant: Raymond Kyungjune Kim, Federal Way, WA (US)

(72) Inventor: Raymond Kyungjune Kim, Federal Way, WA (US)

(73) Assignee: Raymond Kim, Federal Way, WA (US)

( * ) Notice: Subject to any disclaimer, the term of this patent is extended or adjusted under 35 U.S.C. 154(b) by 0 days.

(21) Appl. No.: 14/492,959

(22) Filed: Sep. 22, 2014

(51) Int. Cl.
*F41A 9/83* (2006.01)

(52) U.S. Cl.
CPC ..... *F41A 9/83* (2013.01)

(58) Field of Classification Search
CPC ..... F41A 9/83
USPC ..... 42/87, 88; 86/47; 89/33.1
See application file for complete search history.

(56) References Cited

U.S. PATENT DOCUMENTS

| | | | | |
|---|---|---|---|---|
| 2,403,012 | A * | 7/1946 | McPheters | 86/47 |
| 2,783,570 | A * | 3/1957 | Kunz | 42/87 |
| 2,834,137 | A * | 5/1958 | Kunz | 42/87 |
| 3,789,531 | A * | 2/1974 | Kersten | 42/87 |
| 2012/0192477 | A1* | 8/2012 | Kim | 42/87 |

* cited by examiner

*Primary Examiner* — Reginald Tillman, Jr.

(57) ABSTRACT

The invention provides a sealed ammunition storage box that loads stored ammunition into a firearms magazine. The box includes a hollow interior channel configured to host ammunition cartridges, an opening leading into the channel configured to facilitate the positioning cartridges into the channel and another opening leading into the channel configured to dispense cartridges hosted within the channel into a magazine that is interfaced with the box. The box also includes a handle with a pressing block, the pressing block positioned within the channel through an opening in the box and configured to traverse within the channel to urge cartridges positioned within the channel into a magazine that is interfaced with the box. The box also includes a cover that is selectively engaged and disengaged with the box to encapsulate the openings of the box so as to prevent the movement of objects into and out of the channel.

20 Claims, 13 Drawing Sheets

APPARATUS FOR STORING AND LOADING AMMUNITION

BACKGROUND OF THE INVENTION

1. Field of the Invention

The present invention relates to ammunition cartridge storing and loading tools for firearms magazines.

2. Description of the Prior Art

Despite the advancements in ammunition magazine technology, many contemporary magazine designs are still prone to having their components worn down and soiled from usage and exposure to an outdoors environment. A worn down and soiled magazine can cause malfunctions within firearms.

One problem with many contemporary magazine builds that lead to firearm malfunctions is porous design. Openings within a magazine often allow dirt and moisture from an outdoors environment access to ammunition stored within the magazine. Dirt and moisture that clings to ammunition can eventually be transferred to a firearm's action, where it has the potential to delay or jam the firearm's operational cycling, consequently causing a malfunction.

Though the issue of porous design has been remedied with certain newer magazine designs, older legacy designs still suffer from this issue. For this reason, storing ammunition cartridges within porous magazines that are regularly exposed to outdoors environments is a potential liability to the proper functioning of a firearm.

Another problem with many contemporary magazine builds that leads to firearm malfunctions is weakened magazine spring tension caused by the long term compression of a magazine's spring. Magazine springs are commonly subjected to long term compression when magazines are stored with cartridges for an indefinite period of time. Long term compression can cause a magazine's spring to partially set in a compressed state, reducing its responsiveness and the return force by which it can convey its cartridges to a magazine's feed opening for loading into a firearm's chamber. A spring's reduced response in conveying cartridges to a magazine feed opening can cause a firearm to fail in acquiring a cartridge from the magazine during its chambering cycling, producing a feed malfunction. Therefore, storing cartridges within a magazine for an extended period can be a liability to the proper functioning of a firearm.

One alternative to storing cartridges within a magazine, so as to maintain them from dirt and moisture and prevent reduced magazine spring responsiveness, is to store them in a magazine speed loader; loading the cartridges from the speed loader into a magazine when they are needed for use in a magazine. Unfortunately, the problem with this alternative is that current speed loading tool designs are porous and do not maintain cartridges from dirt and moisture, as they are not designed to store ammunition cartridges for indefinite periods of time in non-sterile environments.

Another alternative to storing cartridges within a magazine, so as to maintain them from dirt and moisture and prevent reduced magazine spring responsiveness, is to store them in a watertight box and transfer them from the box into a magazine when they are needed for use in a magazine. Unfortunately, the problem with this alternative is that if the transfer of cartridges from a watertight box into a magazine were to take place in an outdoors environment, dirt and moisture from the environment or from an operator's hands can bond to cartridges as the cartridges are transferred into the magazine.

At the moment, there are no practical prior art means for sterilely and indefinitely storing ammunition cartridges in an outdoor environment that allows for the reliable and dirt free transfer of cartridges to a firearm.

SUMMARY OF THE INVENTION

In light of the limitations of current ammunition box, speed loader and magazine designs to reliably and sterilely transfer ammunition cartridges to a firearm in an outdoor environment, it is an object of the present invention to provide an apparatus that can reliably and sterilely store, maintain and directly transfer cartridges into a magazine in an outdoor environment, prior to the use of the magazine in a firearm.

According to an embodiment of the invention, an apparatus for storing and loading ammunition cartridges comprises a box that defines a first side, a second side and a tangent side that is tangent with the first and second sides. The box also defines a narrow channel that is configured to host ammunition cartridges and a wide channel that is configured to host a feed opening end of a magazine. The narrow channel and the wide channel converge with one another within the box and collectively define their area of convergence as a cartridge dispensing opening. The first side comprises a receiving opening that converges with the narrow channel and is configured to facilitate the passage of cartridges into the narrow channel. The second side comprises a second opening that likewise converges with the narrow channel, but is sized to prevent the passage of cartridges to and from the narrow channel through the second side opening. The tangent side comprises a magazine interface opening that converges with the wide channel and is configured to facilitate the passage of a feed opening end of a firearms magazine into the wide channel.

According to an embodiment of the invention, an apparatus for storing and loading ammunition cartridges comprises an elongated rectangular block, comprising a proximal broad side. According to an embodiment of the invention, the proximal broad side slideably engages with the box second side and perpendicularly extends a pressing block that engages and traverses within the box narrow channel through the second side opening.

In order to prepare the apparatus for storing or loading ammunition cartridges, cartridges are positioned into the apparatus through the receiving opening, between the pressing block and the cartridge dispensing opening.

According to an embodiment of the invention, an apparatus for storing and loading ammunition cartridges comprises a cover that defines a first and second leg.

According to an embodiment of the invention, an apparatus for storing and loading ammunition cartridges is configured to store and maintain cartridges, that have been positioned within the apparatus, from the dirt and moisture of an outdoor environment with the engagement of the cover to the apparatus box in the following manner:

a first leg of the cover is engaged with the box receiving opening in such a manner as to encapsulate the receiving opening with the first leg, and the second leg of the cover is engaged with the box cartridge dispensing opening in such a manner as to encapsulate the cartridge dispensing opening with the second leg.

According to an embodiment of the invention, an apparatus for storing and loading ammunition cartridges is configured to load cartridges that have been positioned within the apparatus into a magazine with the interfacing of a magazine's feed opening to the apparatus box's cartridge dispensing opening. A feed opening of a magazine is interfaced with the cartridge dispensing opening in such a manner that once interfaced, the orientation of the magazine feed opening relative to the narrow channel allows for cartridges positioned within the narrow channel to translate linearly from the narrow channel through the cartridge dispensing opening into the magazine feed opening in the same angular orientation by which the magazine feed opening, in accordance with its design, dispenses cartridges into a firearm. Following the interfacing of a magazine, the elongated rectangular block is urged in the direction of the magazine feed opening, causing the pressing block to displace cartridges from the narrow channel, through the cartridge dispensing opening into the interfaced magazine feed opening and the magazine.

BRIEF DESCRIPTION OF DRAWINGS

The preferred embodiments of the present invention are described in detail below with reference to the following drawings.

DETAILED DESCRIPTION OF THE PREFERRED EMBODIMENT

Figure 1A:
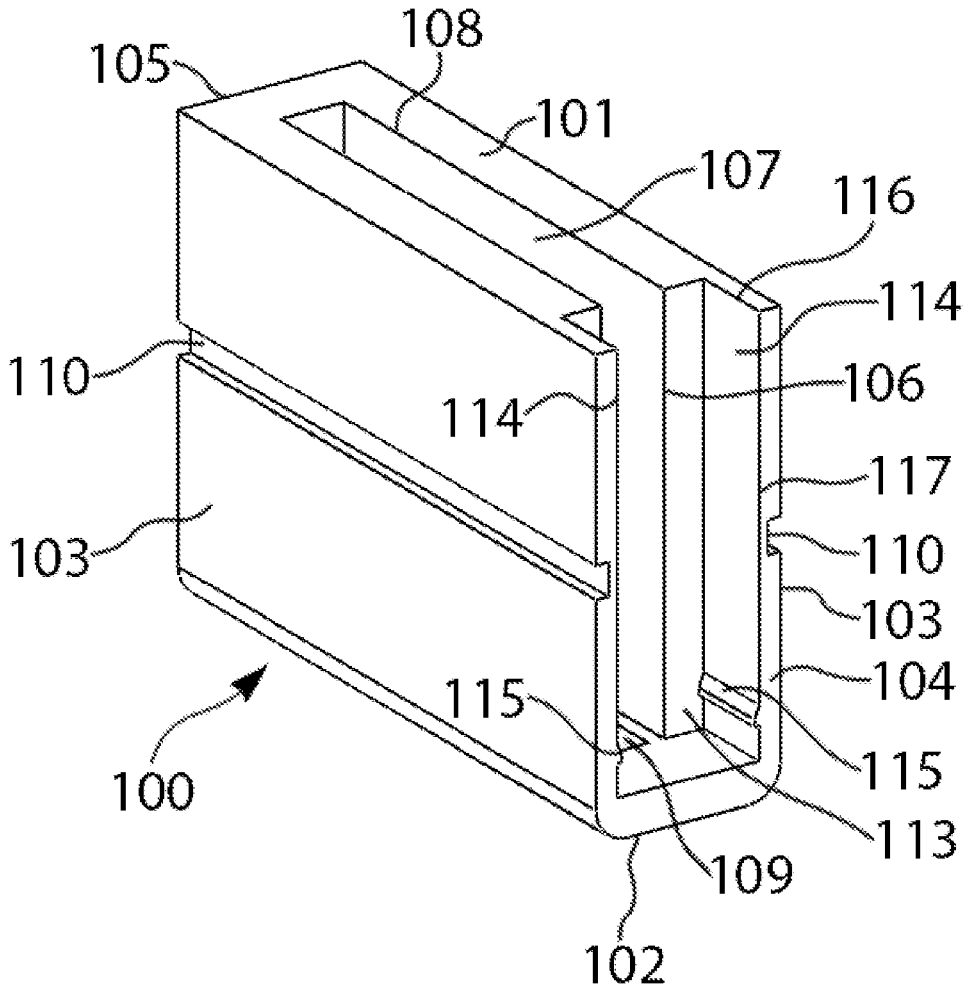
FIG. 1A is a top-down angled side view of the preferred embodiment rectangular box.
Figure 1B:
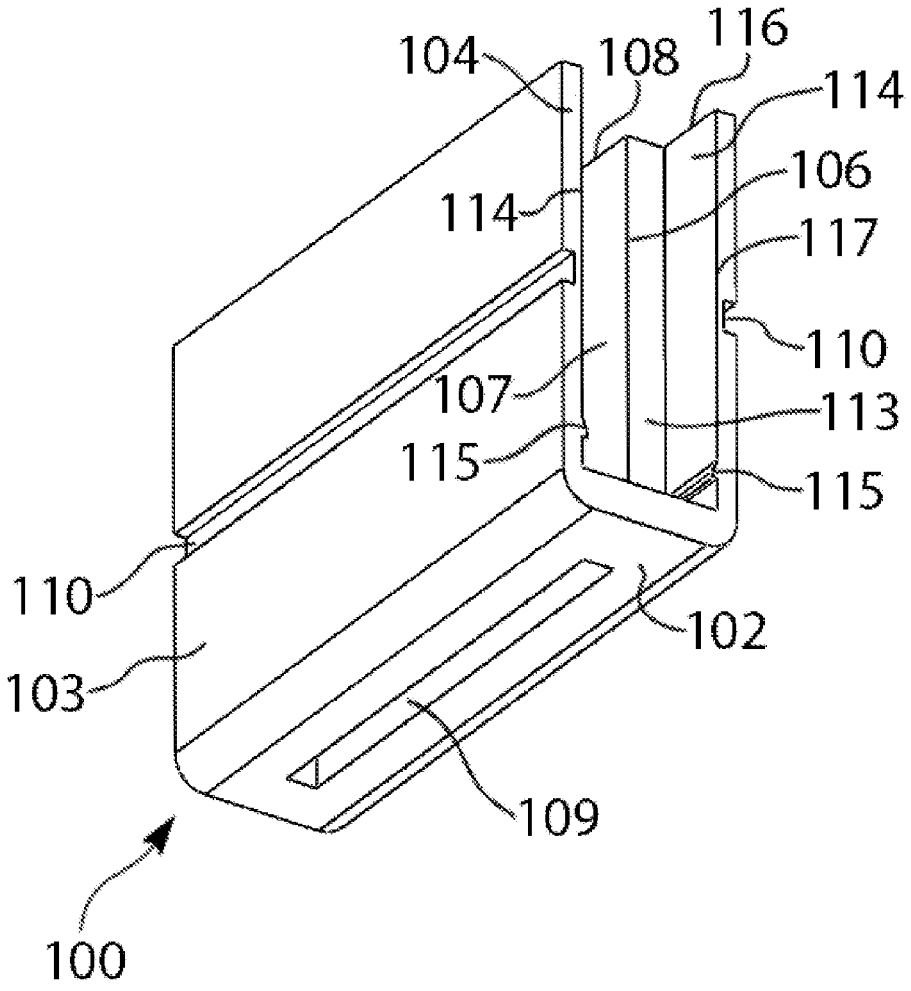
FIG. 1B is a bottom-up angled side view of the preferred embodiment rectangular box.
Figure 1C:
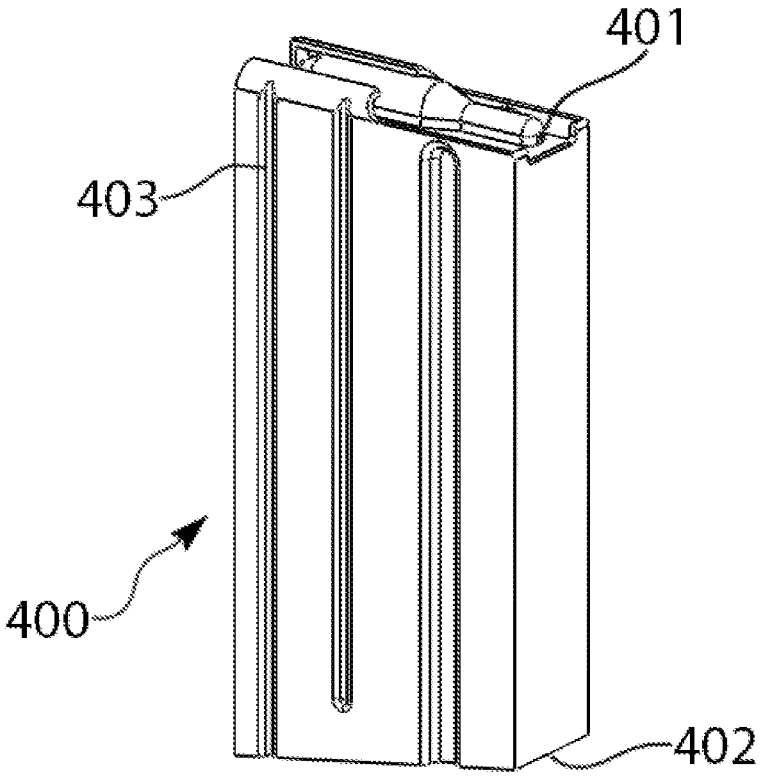
FIG. 1C is an angled side view of an ammunition magazine.
Figure 1D:
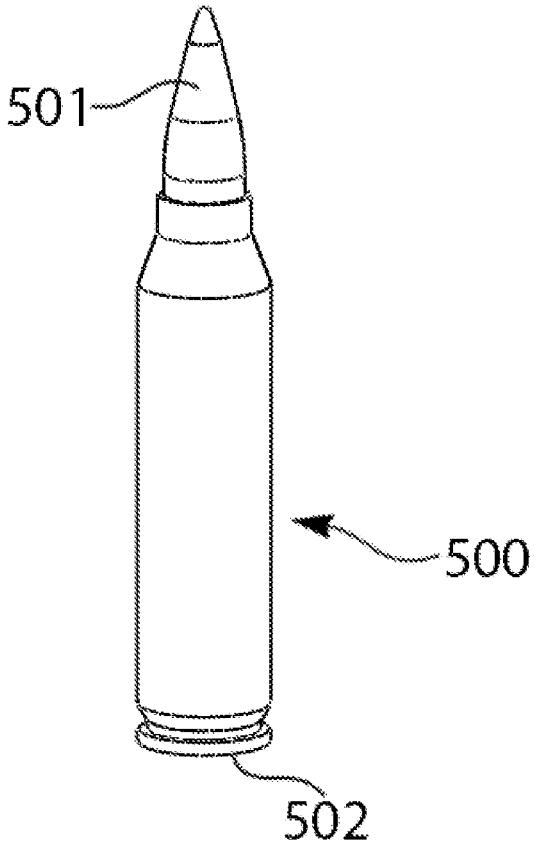
FIG. 1D is an angled side view of an ammunition cartridge.

If reference to FIGS. 1A, 1B, 1C and 1D an apparatus for storing and loading ammunition, in its preferred embodiment, comprises an elongated rectangular box 100. The rectangular box 100 comprises a proximal short side 104 and distal short side 105 on two opposing short sides of the rectangular box 100, a proximal narrow long side 101 and distal narrow long side 102 on two opposing long sides of the rectangular box 100 and two wide long sides 103 on two opposing long sides of the rectangular box 100 that are not occupied by the two narrow long sides 101, 102.

The rectangular box 100 further comprises a wide rectangular magazine channel 113 that runs internally within the rectangular box 100. The magazine channel 113 initiates at the proximal short side 104 and runs toward the distal short side 105 until terminating within the rectangular box 100 after running a limited portion of the length of the rectangular box 100. The magazine channel 113 is exposed out from within the rectangular box 100 through the proximal short side 104 by means of a proximal magazine opening 117. The magazine channel 113 is configured to host a firearms magazine 400 that it receives through the proximal magazine opening 117.

In one embodiment, the magazine channel 113 is also exposed out from within the rectangular box 100 through the proximal narrow long side 101 by means of an adjacent magazine opening 116 that is convergent with the proximal magazine opening 117. In one embodiment, the magazine channel 113 is configured to receive a firearms magazine 400 through the adjacent magazine opening 116 simultaneous to receiving the magazine 400 through the proximal magazine opening 117.

In one embodiment, the width of the magazine channel 113 runs parallel with the width of the rectangular box 100. In one embodiment, the width of the magazine channel 113 is equal to the width of an ammunition magazine 400.

The rectangular box 100 further comprises an internally running narrow rectangular cartridge channel 107. The cartridge channel 107 initiates where the magazine channel 113 terminates within the rectangular box 100 and runs toward the distal short side 105 for a limited portion of the rectangular box 100 length. The cartridge channel 107 is convergent with the magazine channel 113 and the area at which they converge is defined as a cartridge dispensing opening 106. The cartridge dispensing opening 106 is configured to interface with the feed opening 401 of a magazine 400 that is hosted within the magazine channel 113. The cartridge channel 107 is configured to receive, host and store ammunition cartridges 500, as well as guide ammunition cartridges 500 to the cartridge dispensing opening 106 for loading into a magazine feed opening 401 that is interfaced with the cartridge dispensing opening 106.

In one embodiment, the length of the cartridge channel 107 runs parallel with the length of the rectangular box 100. In one embodiment, the height of the cartridge channel 107 is equal to the length of an ammunition cartridge 500. In one embodiment, the height of the cartridge channel 107 runs parallel with the height of the rectangular box 100. In one embodiment, the width of the cartridge channel 107 is equal to the width of an ammunition cartridge 500. In one embodiment, the width of the cartridge channel 107 runs parallel with the width of the rectangular box 100. In one embodiment, the cartridge channel 107 hosts cartridges 500 in a single file that initiates at the cartridge dispensing opening 106 and terminates at the end of the cartridge channel 107 that leads foremost toward the distal short side 105. In one embodiment, the cartridge channel 107 hosts cartridges 500 in a multiple file configuration. In one embodiment, the cartridge channel 107 is of sufficient length to accommodate the width of ten ammunition cartridges 500.

The magazine channel 113 defines two parallel interior inward facing walls 114 on two opposite interior sides of the magazine channel 113 that are not occupied by the proximal magazine opening 117, the adjacent magazine opening 116 or the cartridge dispensing opening 106.

The two inward facing walls 114 each extend a rib 115 that runs parallel with the length of the rectangular box 100. Each rib 115 initiates at the proximal magazine opening 117 and runs to where the magazine channel 113 terminates within the rectangular box 100. The ribs 115 run parallel to one another and are configured to engage within retention grooves 403 found on the exterior facets of ammunition magazines 400. The ribs 115 are positioned on the inward facing walls 114 in such a manner as to engage within the retention grooves 403 of a magazine 400 received into the magazine channel 113 and orient the feed opening 401 of the magazine 400, relative to the cartridge channel 107, in such a manner that cartridges 500 positioned within the cartridge channel 107 are allowed to translate linearly from the cartridge channel 107 through the cartridge dispensing opening 106 into the magazine feed opening 401 in the same angular orientation by which the magazine feed opening 401, in accordance with its design, dispenses cartridges 500 into a firearm. The side of each rib 115 that faces foremost toward the adjacent magazine opening 116 is sloped in such a manner as to create a gradual incline between each inward facing wall 114 and the apex of the rib 115 that is extended by each inward facing wall 114.

The rectangular box proximal narrow long side 101 comprises a proximal channel opening 108 that opens into the cartridge channel 107 and is configured to facilitate the passage of ammunition cartridges 500 into the cartridge channel 107. The rectangular box distal narrow long side 102 comprises a distal channel opening 109 that opens into the cartridge channel 107 and is configured with a width that is sized to prevent the passage of cartridges 500 into and out of the cartridge channel 107 through the distal channel opening 109.

In one embodiment, the width of the distal channel opening 109 is narrower than the width of an ammunition cartridge 500. In one embodiment, the lengths and of the proximal channel opening 108 and distal channel opening 109 correspond with the length of cartridge channel 107.

The two wide long sides 103 of the rectangular box 100 each define guide channels 110 that are recessed into the wide long sides 103. The guide channels 110 run parallel to one another and concurrently run parallel with the length of the cartridge channel 107. In one embodiment, the guide channels 110 initiate at the proximal short side 104 and terminate at the distal short side 105.

Figure 2:
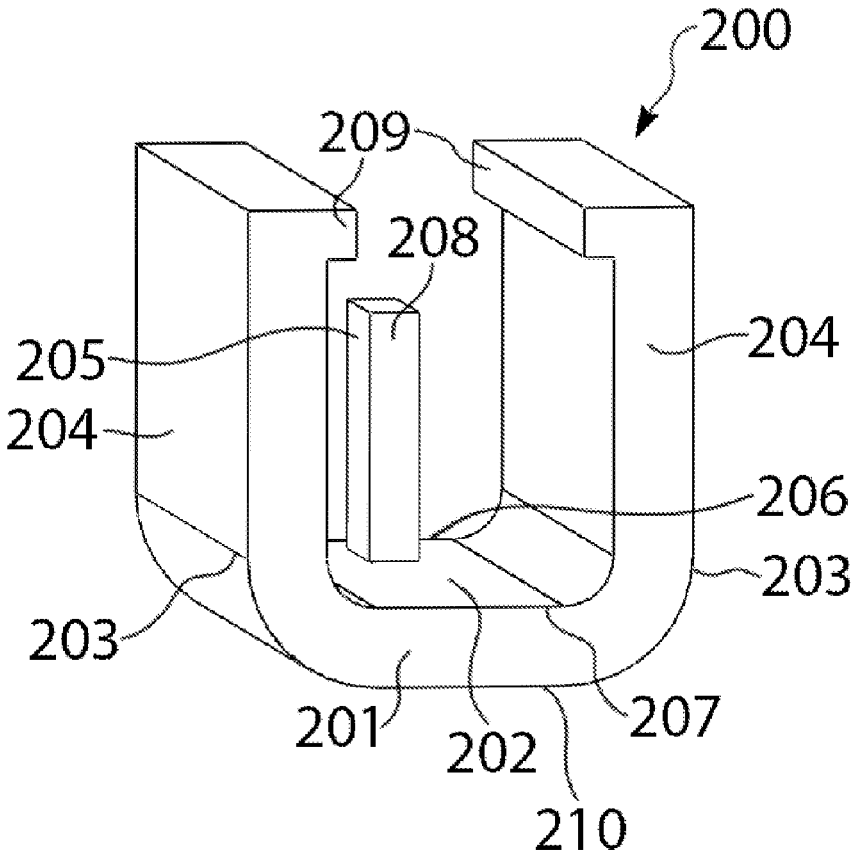
FIG. 2 is an angled side view of the preferred embodiment U-shaped pressing handle bar.

If reference to FIG. 2, the apparatus for storing and loading ammunition further comprises an elongated U-shaped pressing handle bar 200. The pressing handle bar 200 defines an elongated base wall 201 comprised of a proximal broad side 202 and a distal broad side 210 that lies opposite to the proximal broad side 202 on the elongated base wall 201. The proximal broad side 202 defines with two long edges 203 at which it perpendicularly extends two parallel legs 204 that run the length of the elongated base wall 201. The distal broad side 210, in conjunction with the parallel legs 204, is configured to provide a grip by which an operator of the apparatus of the present invention may manipulate the disposition of the pressing handle bar 200.

In one embodiment, the length of the pressing handle bar 200 is equal to the length of the rectangular box distal channel opening 109. In one embodiment, the length of the pressing handle bar 200 is equal to the length of the rectangular box 100.

The elongated base wall 201 perpendicularly extends a rectangular pressing block 205 at the proximal broad side 202. The pressing block 205 is configured with a width that is sized to fit through the rectangular box distal channel opening 109 and a length that runs parallel with the length of the elongated base wall 201.

In one embodiment, the length of the pressing block 205 initiates at a first short edge 206 of the proximal broad side 202 and runs toward an opposite short edge 207 of the proximal broad side 202 for a limited portion of the length of the elongated base wall 201. In one embodiment, the length of the pressing block 205 initiates at a location on the proximal broad side 202 that is staggered a span of distance away from the first short edge 206 and runs toward the opposite short edge 207 for a limited portion of the length of the elongated base wall 201.

The pressing block 205 is configured to interface with cartridges 500 by means of a pressing surface 208, located on a side of the pressing block 205 that faces foremost towards the opposite short edge 207.

Two sides of the pressing handle bar parallel legs 204 that face inward toward one another each perpendicularly extend feet 209. The feet 209 are configured with lengths that run parallel to the length of the elongated base wall 201. Furthermore, the feet 209 are sized and configured to engage within the guide channels 110 of the rectangular box broad sides 103. In one embodiment, the lengths of the feet 209 span the lengths of the parallel legs 204.

Figure 3:
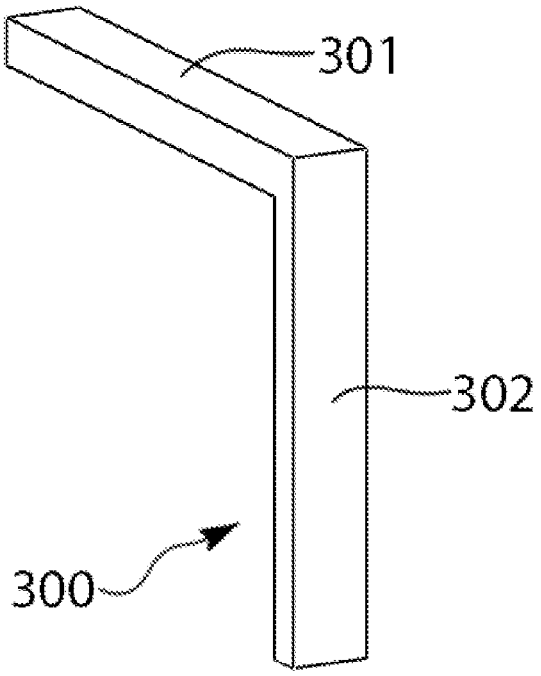
FIG. 3 is an angled side view of the preferred embodiment L-shaped cover.

If reference to FIG. 3, the apparatus for storing and loading ammunition further comprises an L-shaped cover 300 composed of a short leg 302 and a long leg 301 coupled to one another in such a manner as to form a perpendicular L-shape. In one embodiment, the length of the short leg 302 is equal to the height of the cartridge channel 107, the length of the long leg 301 is equal to the length of the proximal channel opening 108 and the width of the short leg 302 and the long leg 301 are equal to the width of the cartridge channel 107.

Figure 4A:
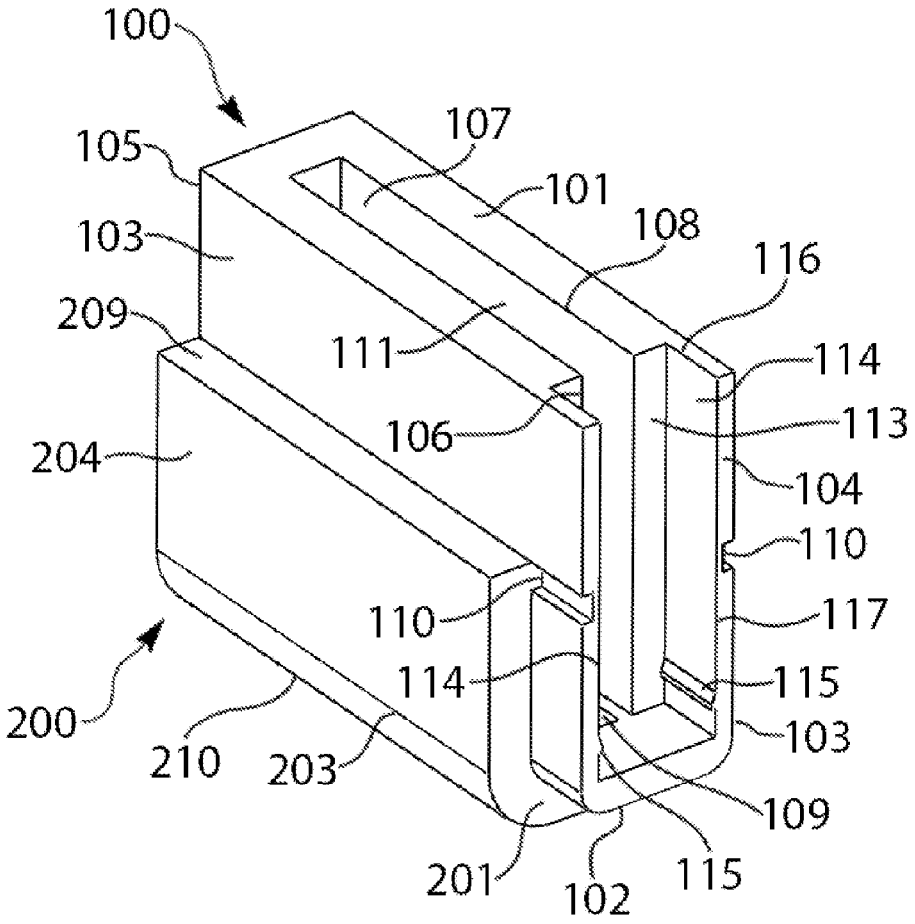
FIG. 4A is an angled side view of the preferred embodiment rectangular box engaged with the preferred embodiment U-shaped pressing handle bar.
Figure 4B:
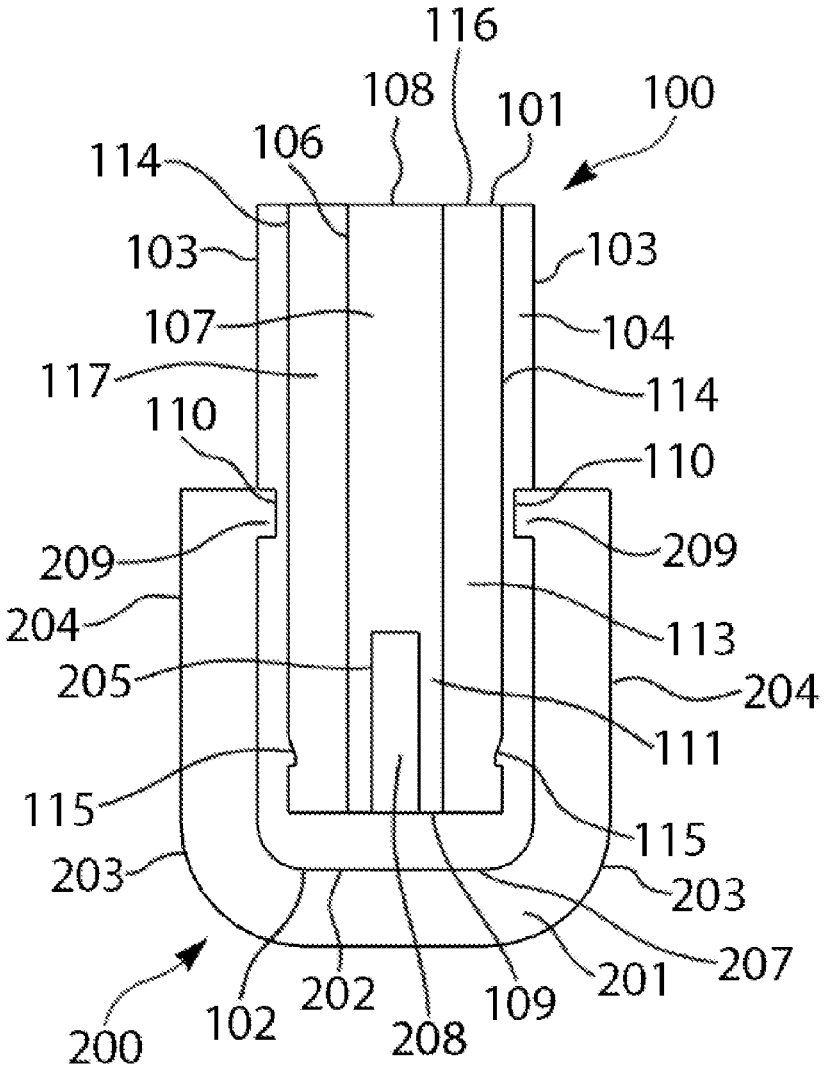
FIG. 4B is a side view of the preferred embodiment rectangular box engaged with the preferred embodiment U-shaped pressing handle bar.

In reference to FIGS. 4A and 4B, the pressing block 205 of the pressing handle bar 200 is positioned within the cartridge channel 107 of the rectangular box 100, through the distal channel opening 109, in such a manner as to allow it to traverse within the cartridge channel 107 along the axis of the length of the cartridge channel 107. The pressing surface 208 of the pressing block 205 is positioned within the cartridge channel 107 in such a manner that it faces foremost toward the cartridge dispensing opening 106. Simultaneous to the positioning of the pressing block 205 within the cartridge channel 107, the feet 209 of the pressing handle bar 200 are slideably engaged within the rectangular box guide channels 110.

In one embodiment, the pressing block 205 is slideably engaged with the distal channel opening 109 as it traverses within the cartridge channel 107. In one embodiment, the pressing handle bar proximal broad side 202 is slideably engaged with the distal narrow long side 102. In one embodiment, the pressing block 205 is positioned within the cartridge channel 107 through the proximal channel opening 108.

In one embodiment, the pressing block 205 is positioned within the cartridge channel 107 in such a manner as to allow the maximum amount of spacing 111 between the pressing surface 208 and the cartridge dispensing opening 106 within the cartridge channel 107. While the pressing block 205 is positioned within the cartridge channel 107 in this manner, the distal channel opening 109 is completely encapsulated by the proximal broad side 202.

Figure 5:
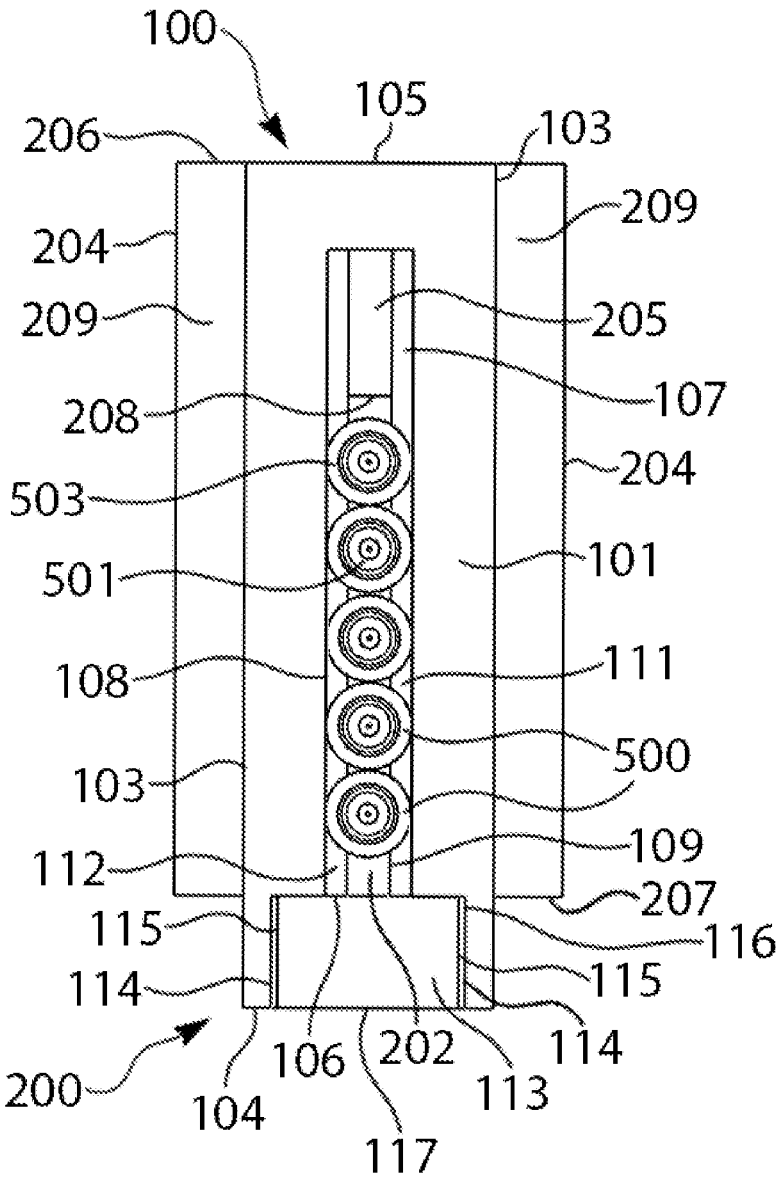
FIG. 5 is a top view of the aggregated preferred embodiment rectangular box and U-shaped pressing handle bar with ammunition cartridges positioned within the rectangular box.

In reference to FIG. 5, ammunition cartridges 500 are inserted through the proximal channel opening 108 into the spacing 111 in the cartridge channel 107 between the pressing block 205 and the cartridge dispensing opening 106. Cartridges 500 positioned into the spacing 111 are obstructed from moving out from the cartridge channel 107 through the distal channel opening 109 by the narrow sizing of the distal channel opening 109.

In one embodiment, cartridges 500 are positioned within the spacing 111 with the bullet tips 501 of the cartridges 500 pointing toward the proximal channel opening 108 and the base primer sides 502 of cartridges 500 facing foremost toward the distal channel opening 109. In one embodiment, cartridges 500 are positioned within the spacing 111 with the bullet tips 501 of the cartridges 500 pointing toward the distal channel opening 109 and the base primer sides 502 of cartridges 500 facing foremost toward the proximal channel opening 108. In one embodiment, the cartridges 500 positioned within the spacing 111 are aligned from the pressing surface 208 to the cartridge dispensing opening 106 in a single file row.

Following the positioning of cartridges 500 into the spacing 111, a gap of reserved space 112 between the cartridges 500 and the cartridge dispensing opening 106 is left unoccupied by the cartridges 500. In one embodiment, the width of this reserved space 112 is equal in size to the thickness of the L-shaped cover short leg 302.

Figure 6:
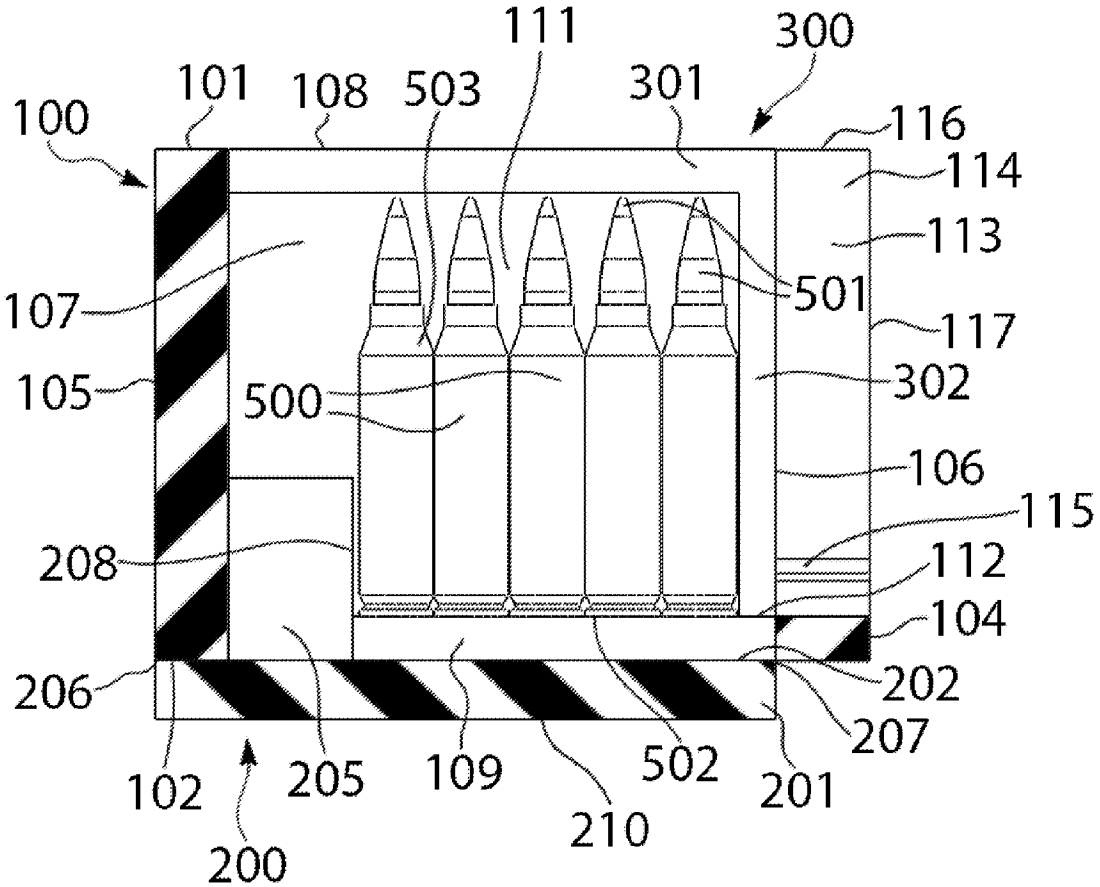
FIG. 6 is a side cross-section view of the aggregated preferred embodiment rectangular box and U-shaped pressing handle, with ammunition cartridges, engaged with the preferred embodiment L-shaped cover.

In reference to FIG. 6, the apparatus for storing and loading ammunition is set to a configuration for storing ammunition via the engagement of the L-shaped cover 300 with the rectangular box 100. The L-shaped cover is engaged with the rectangular box 100 via engaging the L-shaped cover short leg 302 within the reserved space 112 of the cartridge channel 107 in such a manner that the short leg 302 encapsulates the reserved space 112 and obstructs the passage of objects into and out of the cartridge channel 107 through the cartridge dispensing opening 106. Simultaneously, the L-shaped cover long leg 301 is engaged with the proximal channel opening 108 in such a manner that the long leg 301 encapsulates the proximal channel opening 108 and obstructs the passage of objects into and out of the cartridge channel 107 through the proximal channel opening 108.

Figure 7A:
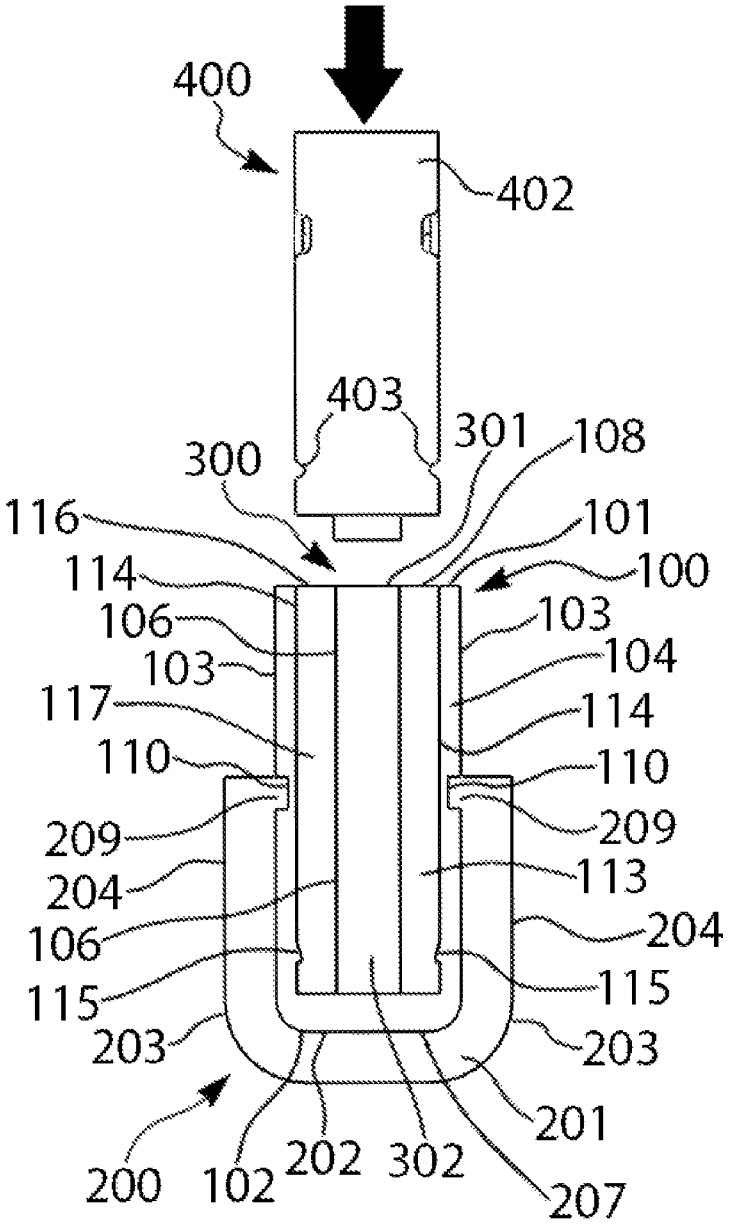
FIG. 7A is a side view of the aggregated preferred embodiment rectangular box and U-shaped pressing handle bar, engaged with the preferred embodiment L-shaped cover, in the process of being interfaced with an ammunition magazine.
Figure 7B:
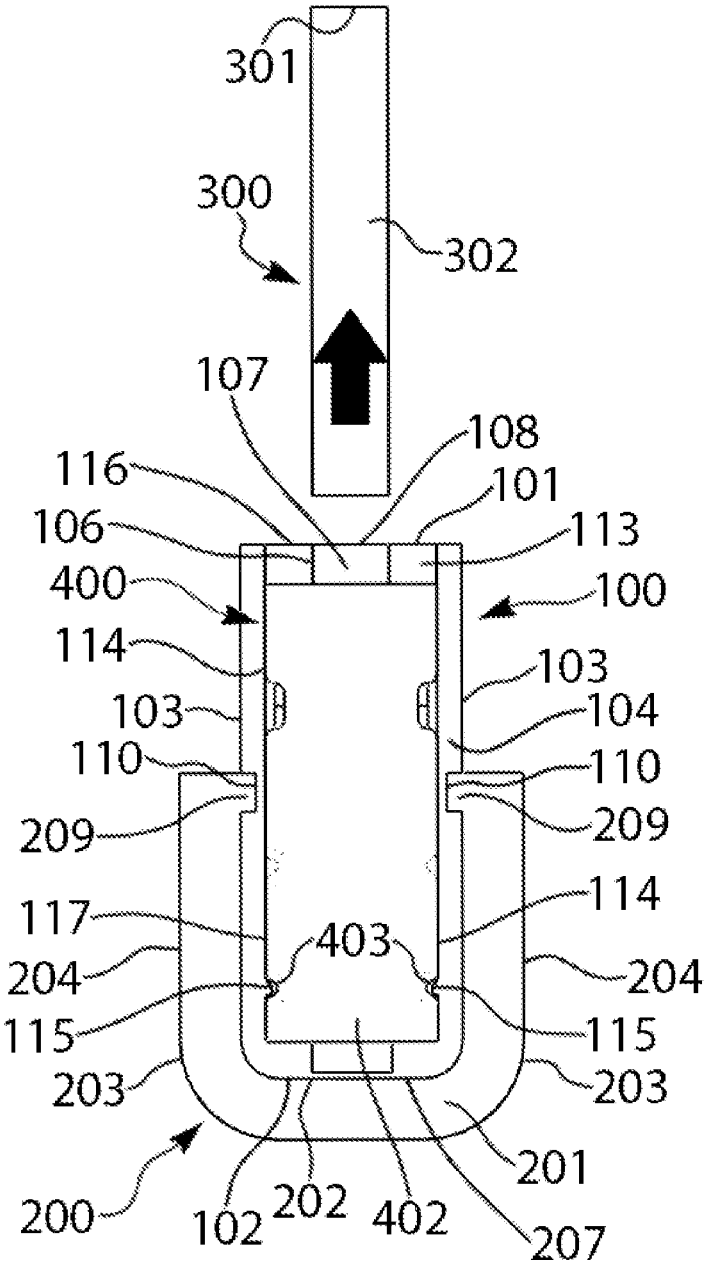
FIG. 7B is a side view of the aggregated preferred embodiment rectangular box and U-shaped pressing handle bar, interfaced with an ammunition magazine, being disengaged with the preferred embodiment L-shaped cover.

In reference to FIGS. 7A and 7B, the apparatus for storing and loading ammunition is set to a configuration for loading ammunition cartridges 500 into a magazine 400 with the engagement of a magazine 400 into the magazine channel 113 and the disengagement of the L-shaped cover 300 from the rectangular box 100.

A magazine 400 is engaged into the magazine channel 113 via slideably engaging the sides of the magazine 400 that contain retention grooves 403 with the magazine channel inward facing walls 114 through the adjacent magazine opening 116. Simultaneously, the magazine feed opening 401 is set into tangency with the cartridge dispensing opening 106 and the magazine 400 is urged in the direction of the ribs 115. Upon coming into contact with the ribs 115, the magazine 400, with the assistance of the sloping of the ribs 115, pushes and widens the spacing between the two ribs 115 until the spacing between the ribs 115 becomes of sufficient size to allow the width of the magazine 400 passage between the ribs 115. The elasticity of the material of the ribs 115 allows for the ribs 115 to flex in order to accommodate this widening in spacing. Upon passing between the ribs 115, the magazine 400 continues to move in its original direction of travel until its retention grooves 403 coincide with the ribs 115. At this point, the elasticity of the material of the ribs 115 forces the ribs 115 to flex back to their original dispositions and narrow the spacing between the ribs 115 around the retention grooves 403. Consequently, this causes the ribs 115 to engage within the retention grooves 403 and prevent the magazine 400 from moving laterally to the lengths of the ribs 115, locking the magazine 400, in place within the magazine channel 113. Subsequently, the magazine feed opening 401 and the cartridge dispensing opening 106 become locked in tangency with one another.

The L-shaped cover 300 is disengaged from the rectangular box 100 by urging the short leg 302 and long leg 301 of the L-shaped cover 300 out through the proximal channel 108 in a direction that leads it away from the cartridge channel 107.

Figure 8:
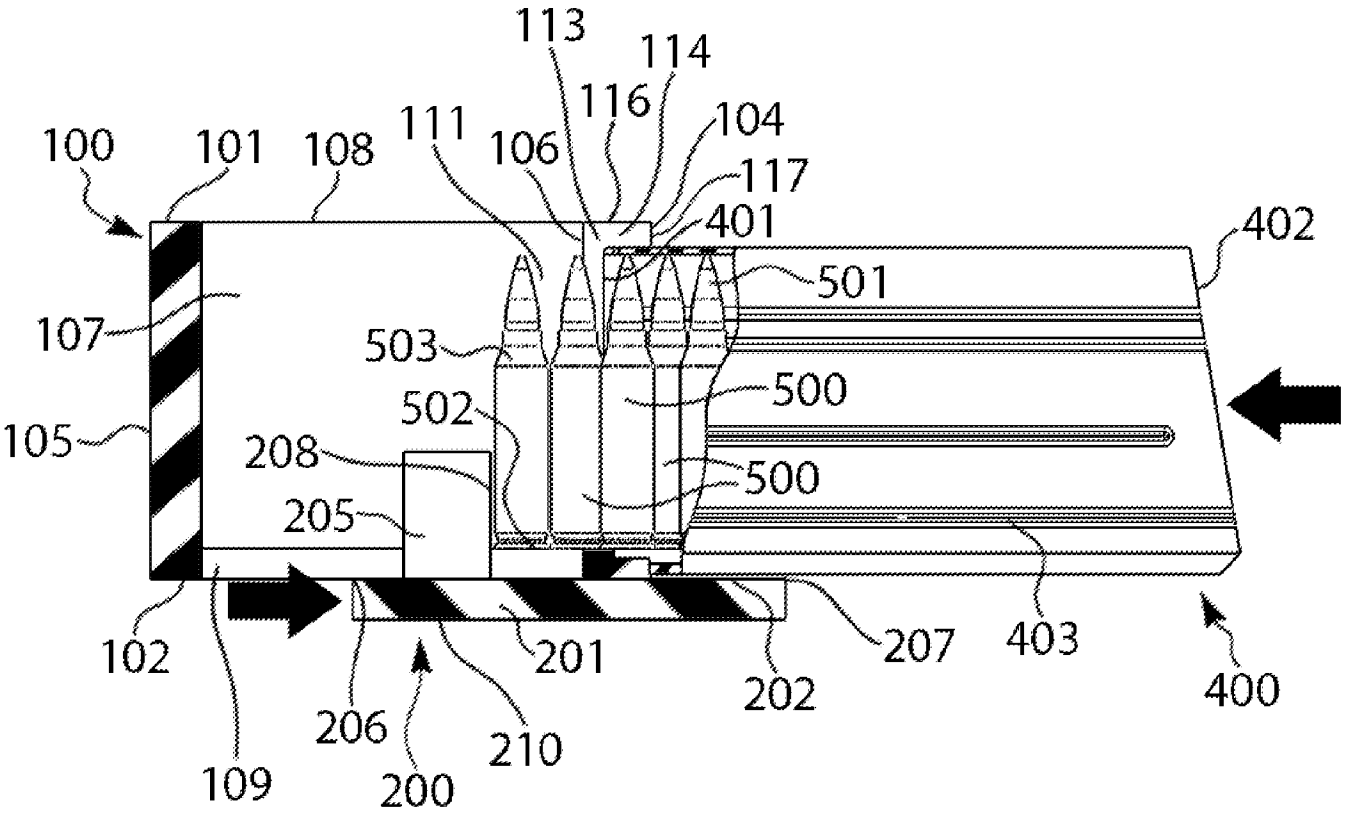
FIG. 8 is a side cross-section view of cartridges being urged from the rectangular box into an interfaced magazine.

In reference to FIG. 8, the pressing handle bar 200 is gripped by an operator's palm and fingers at the distal broad side 210 and parallel legs 204 in such a manner that the operator's hand cups the pressing handle bar 200 by the convex contour of its U-shape. Simultaneously, the magazine 400 is gripped by the operator's unoccupied palm at a magazine base plate 402, which lies opposite to the magazine feed opening 401 on the magazine 400.

By urging of the operator's tangent palm and fingers, the pressing handle bar 200 is translated along the axis of the length of the cartridge channel 107 in the direction of the engaged magazine feed opening 401. This movement, guided by the interlocked sliding engagement of the rectangular box guide channels 110 with the pressing handle bar feet 209, causes the pressing block 205, via the pressing surface 208, to urge an end cartridge 503 of the row of cartridges 500 positioned within the cartridge channel 107 toward the cartridge dispensing opening 106. Subsequently, this forces all of the other cartridges 500 in the row to likewise translate toward the cartridge dispensing opening 106, where they pass through the cartridge dispensing opening 106 and are displaced from the cartridge channel 107. Upon displacement from the cartridge channel 107, the cartridges 500 pass through the interfaced magazine feed opening 401 and are loaded into the magazine 400.

Simultaneous to the urging of the pressing handle bar 200, the magazine base plate 402, by urging of the operator's other palm, is translated along the axis of the length of the cartridge channel 107 in the direction of the cartridge channel 107. As a result, the magazine 400 is urged against the rectangular box 100, causing the magazine feed opening 401 and the cartridge channel 107 to translate in a direction opposite to that being traversed by the pressing surface 208 and the cartridges 500. Consequently, the magazine 400 is translated toward the cartridges 500 simultaneous to the cartridges 500 being urged toward the magazine 400, effectively facilitating the transfer of cartridges 500 from the cartridge channel 107 to the magazine 400 by distributing the amount of force required to urge the cartridges 500 into the magazine 400 between the pressing handle bar 200 and the magazine base plate 402.

The invention claimed is:

1. An apparatus for storing and loading ammunition cartridges, comprising:

a box, comprising a first side, a second side and a tangent side that is tangent with the first and second sides;

a narrow channel, running within the box, configured to host ammunition cartridges;

a wide channel, running within the box and convergent with the narrow channel, configured to host a feed opening end of a magazine;

a receiving opening, located on the first side, configured to converge with the narrow channel and facilitate the passage of cartridges into the narrow channel;

a second opening, located on the second side, configured to converge with the narrow channel;

a magazine interface opening, located on the tangent side, configured to converge with the wide channel and facilitate the passage of a feed opening end of a magazine into the wide channel;

a cartridge dispensing opening, located at the junction at which the narrow channel converges with the wide channel, configured to interface with a magazine feed opening;

an elongated rectangular block, comprising a proximal broad side that is configured to slideably engage with the second side;

a pressing block, extending perpendicularly from the elongated rectangular block at the proximal broad side, configured to engage and traverse within the narrow channel through the second opening and urge cartridges positioned within the narrow channel through the cartridge dispensing opening; and a cover, comprising a first and second leg.

2. The apparatus of claim 1, wherein the second side is on a side of the box that lies opposite to the first side.

3. The apparatus of claim 1, wherein the second side is on a side of the box that lies adjacent to the first side.

4. The apparatus of claim 1, wherein the box is rectangular and the first side and second side comprise two long sides of the rectangular box while the tangent side comprises one short sides of the rectangular box.

5. The apparatus of claim 1, wherein the proximal broad side is slideably engaged with the first side and the pressing block engages and traverses within the narrow channel through the receiving opening side.

6. The apparatus of claim 1, wherein the proximal broad side encapsulates all openings on the side of the box with which is it is slideably engaged.

7. The apparatus of claim 1, wherein the width of the second opening is sized so as to prevent the passage of cartridges to and from the narrow channel through the second opening.

8. The apparatus of claim 1, wherein the elongated rectangular block perpendicularly extends two parallel walls at the proximal broad side that each extend feet.

9. The apparatus of claim 8, wherein the box defines guide grooves that are configured to host, slideably engage with and guide the lateral motion of the feet.

10. The apparatus of claim 8, wherein the elongated rectangular block, in conjunction with the two parallel walls, is configured to serve as a grip.

11. The apparatus of claim 1, wherein the narrow channel aligns cartridges positioned within the narrow channel, between the pressing block and the cartridge dispensing opening, in a linear file.

12. The apparatus of claim 1, wherein two opposing interior walls of the wide channel each extend a rib that is configured to engage within grooves on an ammunition magazine.

13. The apparatus of claim 12, wherein each rib is sloped.

14. The apparatus of claim 12, wherein the ribs are configured to flex away from one other.

15. The apparatus of claim 1, wherein the box comprises multiple narrow channels.

16. A method for sealing cartridge receiving and dispensing openings on an ammunition magazine loading apparatus, the method comprising:

providing the apparatus of claim 1;

engaging a first leg of the cover with the box receiving opening in such a manner as to encapsulate the receiving opening with the first leg; and engaging the second leg of the cover with the box cartridge dispensing opening in such a manner as to encapsulate the cartridge dispensing opening with the second leg.

17. A method for urging ammunition cartridges into a magazine, the method comprising:

providing the apparatus of claim 1;

positioning ammunition cartridges through the receiving opening into the narrow channel, between the pressing block and the cartridge dispensing opening;

following the positioning of cartridges into the apparatus, interfacing a feed opening of a magazine with the cartridge dispensing opening; and following the interfacing of a magazine feed opening, urging the pressing block in the direction of the magazine feed opening while simultaneously urging the magazine feed opening in the direction of the pressing block, displacing the cartridges from the narrow channel through the cartridge dispensing opening into the interfaced magazine feed opening and the magazine.

18. The method of claim 17, wherein the pressing block is urged via the application of force applied by an operator's hand on the elongated rectangular block and the two parallel walls.

19. The method of claim 17, wherein the magazine feed opening is urged via the application of force applied by an operator's hand on the magazine body.

20. The method of claim 17, wherein the magazine feed opening is interfaced with the cartridge dispensing opening in such a manner that the orientation of the magazine feed opening relative to the narrow channel allows for cartridges positioned within the narrow channel to be urged linearly from the narrow channel through the cartridge dispensing opening into the magazine feed opening in the same angular orientation by which the magazine feed opening, in accordance with its design, dispenses cartridges into a firearm.

* * * * *